United States Patent [19]

Thompson

[11] Patent Number: 4,856,673

[45] Date of Patent: Aug. 15, 1989

[54] CONTAINER CONVERTIBLE TO A CHILD'S PAIL

[75] Inventor: Joseph Thompson, Upper Saddle River, N.J.

[73] Assignee: Sterling Drug Inc., New York, N.Y.

[21] Appl. No.: 211,922

[22] Filed: Jun. 27, 1988

[51] Int. Cl.[4] ..... B65D 23/10; A63H 33/32

[52] U.S. Cl. ..... 220/94 R; 220/91; 206/216; 215/100 A; 446/71

[58] Field of Search ..... 220/91, 94 R; 206/216; 215/100 A; 446/71, 75, 76, 77

[56] References Cited

U.S. PATENT DOCUMENTS

| | | | |
|---|---|---|---|
| 3,100,576 | 8/1963 | Frank | 215/100 A X |
| 3,275,366 | 9/1966 | Hidding | 215/100 A X |
| 3,586,200 | 6/1971 | Kramer | 220/94 R |
| 3,638,823 | 2/1972 | McCoy | 215/100 A |
| 3,709,544 | 1/1973 | Oltmanns | 220/94 R X |
| 3,815,281 | 6/1974 | Kander | 446/77 |
| 4,029,248 | 6/1977 | Lee | 16/114 R |
| 4,103,774 | 8/1978 | Shingyouchi | 446/75 X |
| 4,106,657 | 8/1978 | Dogliotti | 446/71 |
| 4,399,926 | 8/1983 | Eidels-Dubovoy | 220/94 R X |
| 4,574,947 | 3/1986 | Hutchings | 206/216 X |
| 4,669,627 | 6/1987 | Ueda et al. | 220/94 R |
| 4,673,625 | 6/1987 | McCartney et al. | 220/94 R X |
| 4,758,194 | 7/1988 | Wyatt | 446/71 |

*Primary Examiner*—John Rivell

*Attorney, Agent, or Firm*—Wenderoth, Lind & Ponack

[57] ABSTRACT

A container convertible to a child's pail includes a generally hollow container body having an annular handle-accommodating groove extending therearound, a closure detachably secured to the container body and a handle. When the container is in use as a storage receptacle, the handle is supportable on the container body at a stored position within the handle-accommodating groove. The container can be converted to a child's pail by removing the closure, removing the handle from the handle-accommodating groove and securing the handle to attachment members of the container body so that the handle extends in a pail-facilitating position.

11 Claims, 3 Drawing Sheets

CONTAINER CONVERTIBLE TO A CHILD'S PAIL

BACKGROUND OF THE INVENTION

The present invention relates to containers for storing disposable items used around the home, and in particular, containers for storing disposable moist towlettes for a child's hygiene.

Containers for storing disposable moist towlettes are known. The containers generally comprise a hollow container body over which a removable closure is disposed. Typically, the closure has a dispensing opening through which the moist towlettes can be removed from the container body with the closure thereon. When all of the towlettes have been used up, the container is generally disposed of.

SUMMARY OF THE INVENTION

An object of the present invention is to provide a container of the aftermentioned type in which, once the contents thereof have been used up, the container can be converted to a child's pail for use at the beach or in a sandbox, etc.

To achieve this object, the present invention comprises a generally hollow container body having a handle-accommodating groove defined in either of the inner or outer peripheral surfaces thereof, and in which handle-accommodating groove a pail handle is supportable by the container at a stored position. When the contents of the container are used up, the pail handle can be removed from the handle-accommodating groove and can be secured to attachment elements on the container body in a pail-facilitating position thereby completing the conversion of the container to a child's pail.

BRIEF DESCRIPTION OF THE DRAWINGS

This and other objects and features of the present invention will become more apparent to those of ordinary skill in the art reviewing the following detailed description of the preferred embodiments made in conjunction with the accompanying drawings, in which.

DETAILED DESCRIPTION OF THE PREFERRED EMBODIMENTS

Referring to FIGS. 1–4 and 8, a first preferred embodiment of the present invention includes a generally hollow container body 1 having a top opening, an inner peripheral surface and an outer peripheral surface (not numbered). A closure 3 is removably secured to the container body 1 over the top opening thereof. The closure 3 may include a well-known dispensing opening for allowing the contents contained in the container body 1 to be removed therefrom while the closure 3 is disposed over the top opening of the container body 1.

Figure 2:
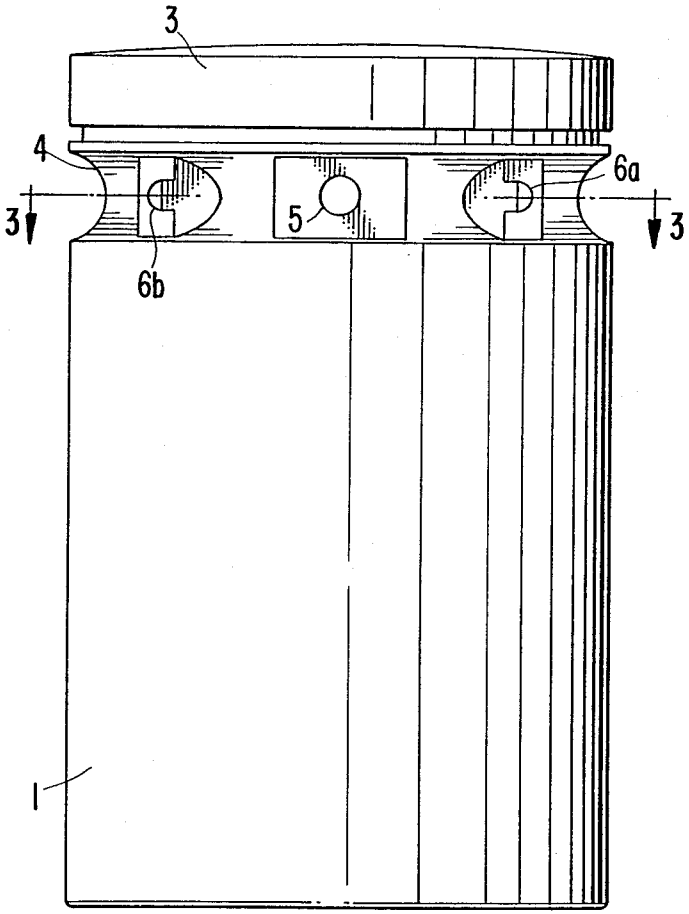
FIG. 2 is a vertical elevation view of the container of FIG. 1 without the handle.
Figure 1:
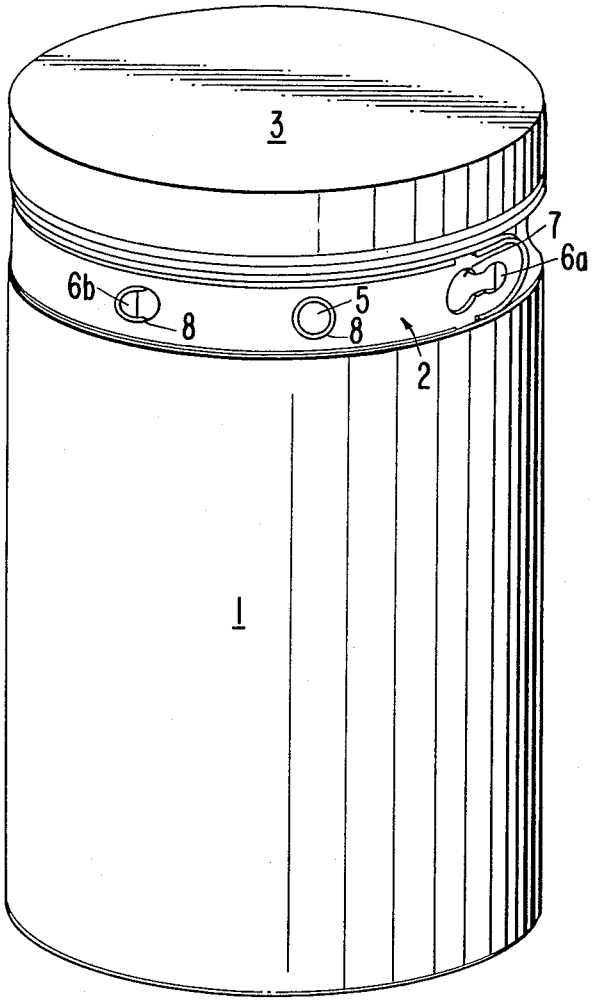
FIG. 1 is a perspective view of a container convertible to a child's pail according to a first embodiment of the present invention, showing a handle thereof in a stored position.

The container body 1 further includes an annular handle-accommodating groove 4 extending therearound and open to the outer peripheral surface of the container body. As can be seen in FIG. 1, a handle 2 is supported by the container body 1 in the handle-accommodating groove 4. The handle comprises a flexible strip of plastic material.

Figure 4:
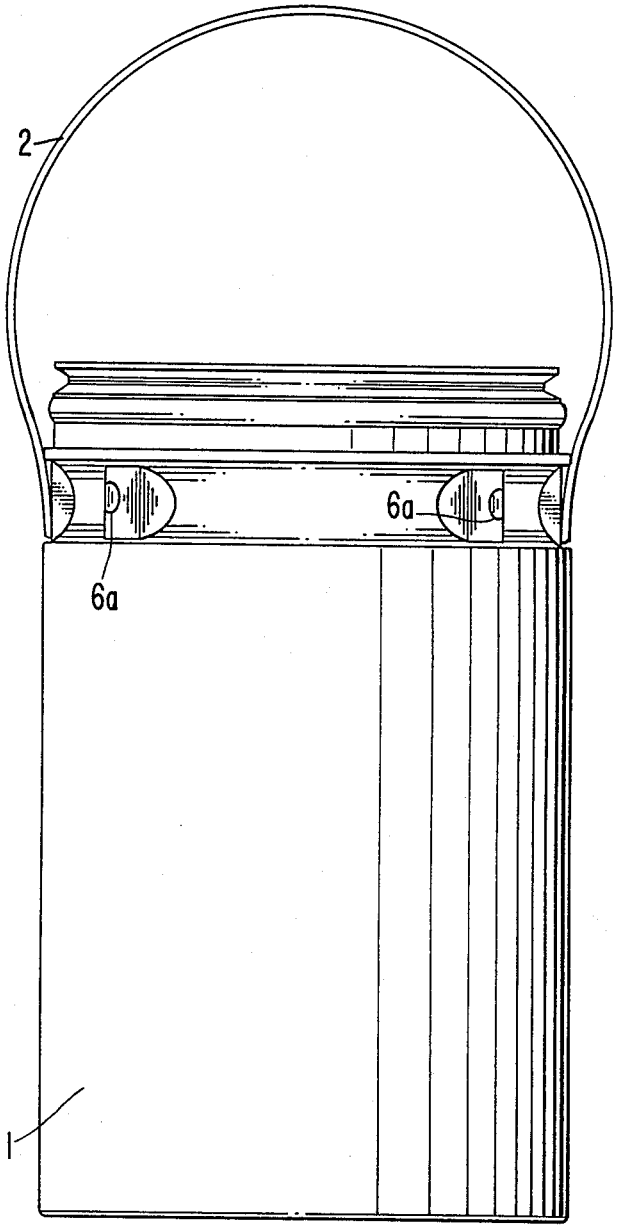
FIG. 4 is a vertical elevation view of the first embodiment of the present invention with the closure thereof removed and the handle shown in a pail-facilitating position.

When the closure 3 is removed, the handle 2 can be removed from the handle-accommodating groove 4 and attached to the container in a pail-facilitating position as shown in FIG. 4.

Figure 3:
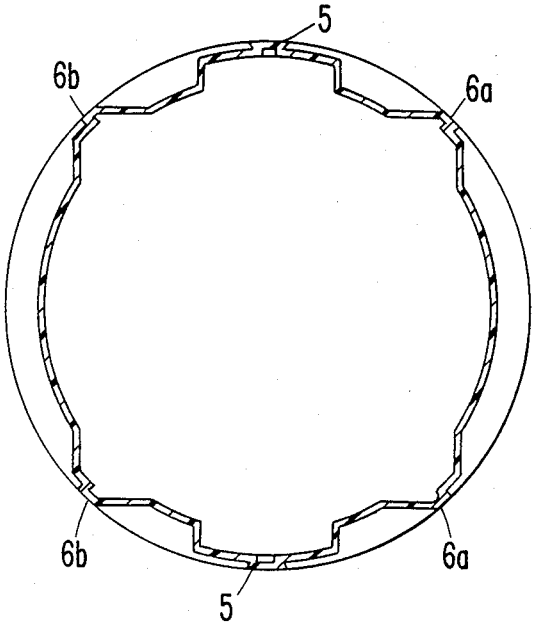
FIG. 3 is a cross-sectional view taken along line 3—3 in FIG. 2.
Figure 8:
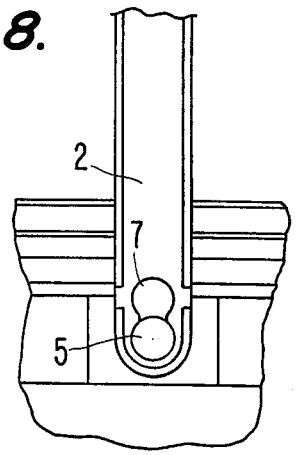
FIG. 8 is an explanatory diagram illustrating the connection of the handle via a securing means thereof to an attachment element of the container body according to the preferred embodiments of the present invention.

The specific structure of the first embodiment of the present invention that contributes to the support of the handle 2 in the handle-accommodating groove 4 and the attachment of the handle 2 to the container body will now be specifically described with particular reference to FIGS. 1, 3 and 8. According to the first embodiment of the present invention, the container body 1 includes attachment means disposed in the handle-accommodating groove. The attachment means comprises, as shown in FIG. 3, a first pair of attachment elements 5,5 which extend radially with respect to the container body 1, and at least one second pair of attachment elements *6a*, *6b*, or *6b*, *6b* defining hooks that extend toward one another in the handle-accommodating groove 4. None of the attachment elements disposed in the handle-accommodating groove 4 project beyond the outer peripheral surface of the container body 1.

When the handle is supported by the container body 1 in the stored position shown in FIG. 1, the second pair of attachment elements *6a*, *6a* or *6b*, *6b* are respectively received in keyhole openings 7 extending in ends of the handle 2. More specifically, the keyhole opening 7 in one end of the handle is hooked over one of the attachment elements *6a* and the handle 2 is wrapped around the container body 1 until the keyhole opening 7 extending in the other end of the handle 2 is disposed over the other of the second pair of attachment elements *6a*. This keyhole opening can then be snapped over the second one of the attachment elements *6a* to complete the securement of the handle 2 to the container body. The handle 2 also has openings 8 extending therethrough so as to accommodate the first pair of attachment elements 5 and the other pair of attachment elements *6b*, *6b* when the handle extends in the handle-accommodating groove 4 in the stored position.

When the closure 3 is removed and the handle 2 is removed from the handle-accommodating groove 4, the handle 2 can be secured to the container body 1 in the manner shown in FIG. 8. Specifically, each of the first pair of attachment elements 5 can be inserted through the large upper open end portion of the keyhole opening 7 comprising the securing means of the handle 2, and the handle 2 can be pulled upwardly whereby the attachment element 5 cams apart a neck portion of the keyhole opening and extends in a smaller open portion of the keyhole opening 7 in the position shown in FIG. 8.

Now, a second embodiment of the present invention will be described with reference to FIGS. 5–8. However, it should be noted that like numerals referring to like elements in FIG. 1 have been employed and the description thereof has been omitted with respect to the second embodiment for brevity.

Figure 5:
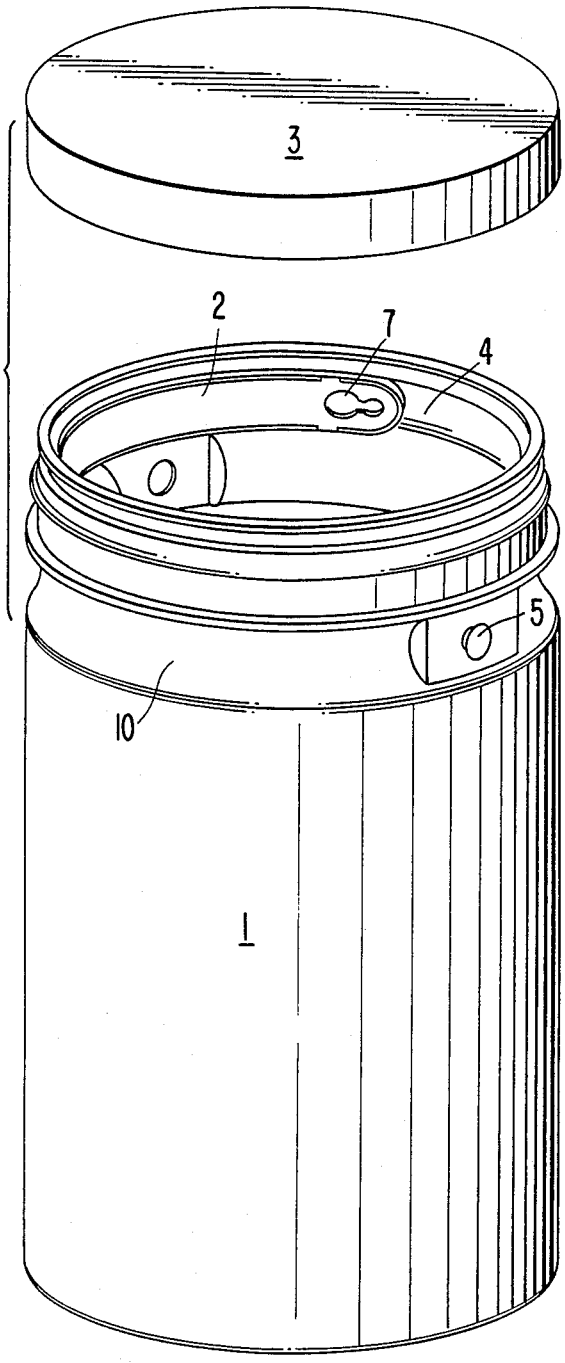
FIG. 5 is an exploded perspective view of a container convertible to a child's pail according to a second embodiment of the present invention.
Figure 6:
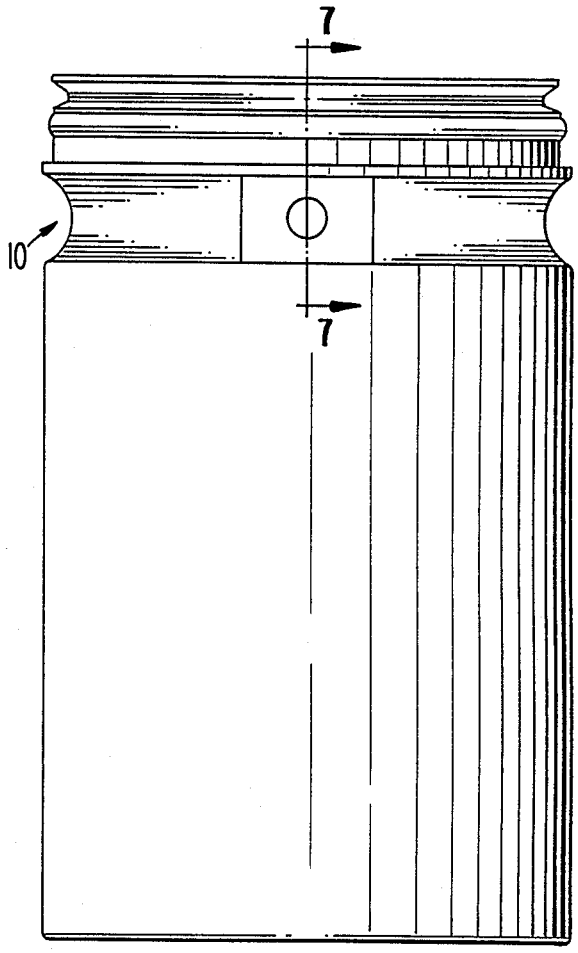
FIG. 6 is a vertical elevation view of the container of FIG. 5.
Figure 7:
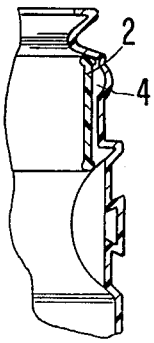
FIG. 7 is a partial cross-sectional view of the second embodiment of the present invention taken along line 7—7 in FIG. 6.

The second embodiment of the present invention is substantially similar to the first embodiment with one exception residing in that while the handle-accommodating groove 4 is open to the outer peripheral surface of the container body in the first embodiment, the handle-accommodating groove 4 in the second embodiment is open to the inner peripheral surface of the container body. As can be seen in FIG. 5, when the handle 2 extends in the handle-accommodating groove 4 within the container when in the stored position, since the handle body 2 comprises a flat strip of flexible plastic material, the handle 2 is self-seated in the handle-accommodating groove 4 under its own resiliency. Accordingly, the second pair of attachment elements *6a, 6a* or *6b, 6b* employed in the first embodiment of the present invention are not required in the second embodiment to support the handle 2 on the container body when the handle is in the stored position.

When the closure 3 is removed and the handle 2 is removed from the handle-accommodating groove 4, as in the first embodiment of the present invention, the handle 2 can be detachably secured to the container body 1 in the pail-facilitating position via engagement of the attachment elements 5 to the handle 2 in the keyhole openings thereof as shown in FIG. 8. The attachment elements 5 are disposed in a recessed portion 10 of the container body 1 so as not to extend beyond the outer peripheral surface of the container body 1.

While the description of the present invention has been made with reference to specific embodiments, it should be understood that other modifications and changes that fall within the true spirit and scope of the present invention will become apparent to those of ordinary skill in the art. Therefore, the specification is seen to be illustrative and not limitative of the present invention, the present invention being defined solely in the appended claims.

What is claimed is:

1. A container convertible to a child's pail comprising:

a generally hollow container body having a top opening, an inner peripheral surface, an outer peripheral surface, an annular handle-accommodating groove extending therearound and open to one of said peripheral surfaces, and attachment means exposed at said outer peripheral surface and including a first pair of attachment elements disposed diametrically opposite one another adjacent said top opening; and a handle having opposite ends, and respective securing means at each of said ends, each of said securing means detachably securable to a respective one of said attachment elements, said handle supportable by said container in a stored position at which said handle extends in said handle-accommodating groove, and said handle detachably mountable to said container in a pail-facilitating position at which the securing means of said handle are detachably secured to the pair of attachment elements of said container body, respectively.

2. A convertible container as claimed in claim 1, wherein said handle-accommodating groove is open to the inner peripheral surface of said container body.

3. A convertible container as claimed in claim 2, wherein said handle comprises flexible material and is resiliently seated in said handle-accommodating groove when in said stored position.

4. A convertible container as claimed in claim 1, wherein said handle-accommodating groove is open to the outer peripheral surface of said container body.

5. A convertible container as claimed in claim 4, wherein said attachment means further includes a second pair of attachment elements, said second pair of attachment elements disposed in said handle-accommodating groove and respectively engageable with the securing means of said handle for detachably fixing said handle to said container body in the handle-accommodating groove when said handle is in said stored position.

6. A convertible container as claimed in claim 5, wherein said handle-accommodating groove extends around said container body adjacent said top opening thereof, and said first pair of attachment elements are also disposed in said handle-accommodating groove.

7. A convertible container as claimed in claim 6, wherein said handle has a pair of openings extending therethrough and in which said first pair of attachment elements extend when said handle is in said stored position.

8. A convertible container as claimed in claim 1, wherein said first pair of attachment elements extend in a radial direction with respect to said container body and said securing means comprise respective keyhole openings extending in said handle.

9. A convertible container as claimed in claim 2, wherein said container body has a recessed portion defined in said outer peripheral surface, said first pair of attachment elements are disposed in said recessed portion and extend in a radial direction with respect to said recessed portion, and said securing means comprise respective keyhole openings extending in said handle.

10. A convertible container as claimed in claim 5, wherein said first pair of attachment elements extend within said handle-accommodating groove in a radial direction with respect to said container body, said second pair of attachment elements comprise hooks extending toward one another, and said securing means comprise respective keyhole openings extending in said handle.

11. A convertible container as claimed in claim 1, and further comprising a closure detachably mountable to said container body over said top opening.

* * * * *